United States Patent [19]

Mizelle

[11] 4,091,736

[45] May 30, 1978

[54] INCAPACITATING ANTI-PERSONNEL SMALLARMS PROJECTILE

[76] Inventor: William Robert Mizelle, 1330 New Hampshire Ave. NW, Washington, D.C. 20036

[21] Appl. No.: 767,457

[22] Filed: Feb. 10, 1977

[51] Int. Cl.[2] ..... F42B 11/36

[52] U.S. Cl. ..... 102/92.7; 102/41

[58] Field of Search ..... 102/41, 92, 92.6, 92.7; 244/3.1

[56] References Cited

U.S. PATENT DOCUMENTS

| | | | |
|---|---|---|---|
| 3,386,381 | 6/1968 | Ferb | 102/92 |
| 3,417,697 | 12/1968 | Lucy et al. | 102/41 |
| 3,502,025 | 3/1970 | Payne | 102/92 |
| 3,866,537 | 2/1975 | Greenberg | 244/3.1 |

FOREIGN PATENT DOCUMENTS

| | | | |
|---|---|---|---|
| 1,366,039 | 9/1974 | United Kingdom | 102/92 |

*Primary Examiner*—Verlin R. Pendegrass

[57] ABSTRACT

An incapacitating projectile to replace the conventional lethal bullet in the corresponding cartridges for various smallarms in general use, notably including police sidearms. In this projectile, propelled by a conventional smallarms powder charge, atmospheric air in a chamber inside the projectile — as target impact retards the projectile body and a piston in this chamber travels forward — is heated through compression, and further heated through friction, as the same piston travel ejects this intensely heated air upon its human or animal target, through a "pinhole" aperture in the projectile's nose.

Because this arrangement incapacitates instantly by inflicting an intolerably acute localized burn, the projectile body may be of material of mass low enough to prevent or minimize the possibility of a serious penetrating or blunt-trauma wound. If the projectile body is of such low-mass material, the rapid decay of bullet energy downrange in the event of a miss obviates virtually all risk of its inflicting painful, much less lethal or serious, injury upon bystanders.

9 Claims, 5 Drawing Figures

INCAPACITATING ANTI-PERSONNEL SMALLARMS PROJECTILE

BACKGROUND OF THE INVENTION

For some years, the munitions art has sought to devise a projectile or missile of minimum lethality which will immediately incapacitate a human being, primarily for law-enforcement use. The more society and the law have stressed the need to keep the peace and protect the public with minimum necessary force, the more police officers have hesitated to shoot, often with result fatal to themselves.

Outside the law-enforcement field, as householders and shopkeepers have increasingly looked to personal firearms for protection against rising violent crime, gun accidents and impulse shootings have added to the national gunshot toll.

Since the only generally accepted reason for firing a deadly bullet at anyone is to deter him in the act of killing or hurting someone else, humane hesitance to fire has permitted violent suspects to escape. More felons have escaped when police officers could not fire because of the danger to bystanders, nearby or at a distance.

Police forces still need and want an incapacitating alternative to deadly gunfire. For in the bulk of the many proposed alternatives developed to date, law-enforcement users have noted drawbacks. Examples:

Gun-fired tranquillizer darts or projectiles, in practice, have lacked a drug or drugs quick enough in taking effect upon a human target. Aside from this drawback, one man's lethal dose of most such agents would fail to subdue another.

These darts also share other drawbacks, police equipment specialists observe, with various gun-fired projectiles developed in the search.

Most of these must be larger and longer than a regular bullet, which would require the user to carry a second, separate launcher gun, and to decide — typically in split-seconds — which to draw and use. Generally, these require reloading after every shot, have very limited accurate range, and/or are ineffective unless they strike the head, which is too small a target.

The most frequent law-enforcement objection to proposed alternatives to the conventional bullet is that they offer insufficient certain latitude between risk of serious injury and failure to incapacitate.

Finally, typical of most gun-fired low-lethality incapacitating projectiles proposed to date is a complexity of structure that invites malfunctions in "street use", police specialists feel. This complexity also entails relatively high cost of manufacture, which would price them out of the reach of the typically tightly-budgeted police department.

SUMMARY OF THE INVENTION

This invention relates generally to the munitions art, but more particularly to a projectile which will impinge upon the person struck an incapacitatingly hot jet or puff of air. Its structure and function adapt the projectile body to being made of material sufficiently light in weight and mass (such as but not necessarily confined to solid nylon) so that it shall be unlikely to penetrate and inflict the serious wound characteristic of a metallic bullet.

The primary object of this invention is to provide a projectile capable of subduing or deterring a violent individual. To this end, the projectile converts a major part of its kinetic energy, imparted by a conventional smallarms propellant charge, into heating the air which naturally occupies a chamber provided within the projectile body and communicating with the atmosphere. Upon impact, the bullet projects this superheated puff of air against the target.

A related object is to incapacitate as quickly and positively, or more so, than does a wound by a common bullet, which may not immediately deter a determined individual, as will the acute "sting" caused by this invention.

A further object of this invention is to provide a projectile which has such capability if constructed in a size and form to fit smallarms cartridge cases in general use, and to function in the actions of, and when fired by, the corresponding smallarms in general use.

Another object of this invention is to provide such a projectile which is as accurate as the conventional bullet at selected reduced ranges characteristic of anti-crime "shooting situations". A related object, if such a projectile is constructed of suitable low-mass material, is that it shall be virtually harmless to anyone beyond the reduced range of its intended target.

A further object is to provide a gun-fired projectile that will deter the attack or intrusion of a domestic or wild animal which it is not desired to destroy or injure.

Other objects and advantages will become apparent from the following description of the invention's function, which refers to the accompanying drawing figures.

DESCRIPTION OF THE DRAWINGS OF A PREFERRED EMBODIMENT

Figure 1:
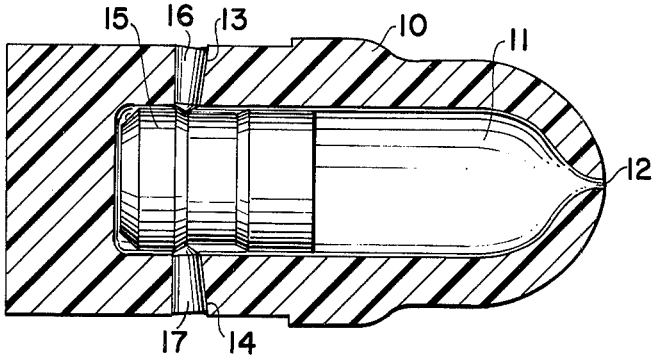
FIG. 1 is a cross-sectional view of an embodiment of the projectile disclosed, showing the slidable piston retained in the rear portion of the projectile chamber.

FIG. 1 is a longitudinal cross-section of an exemplary projectile having the structure of the subject invention. Integral with the projectile body 10 are the projectile chamber 11, containing the slidable piston 15 with air space ahead of it, the pinhole aperture 12, and the piston retainer plug holes 13 and 14.

The only other components are the piston retainer plugs 16 and 17, which retain the piston 15 in its after position during handling, firing and projectile flight. (If not retained, the piston 15 would tend to creep forward within the chamber 11 during projectile flight if the piston 15, as is intended, has far greater mass and weight than the projectile body 10.)

Figure 2:
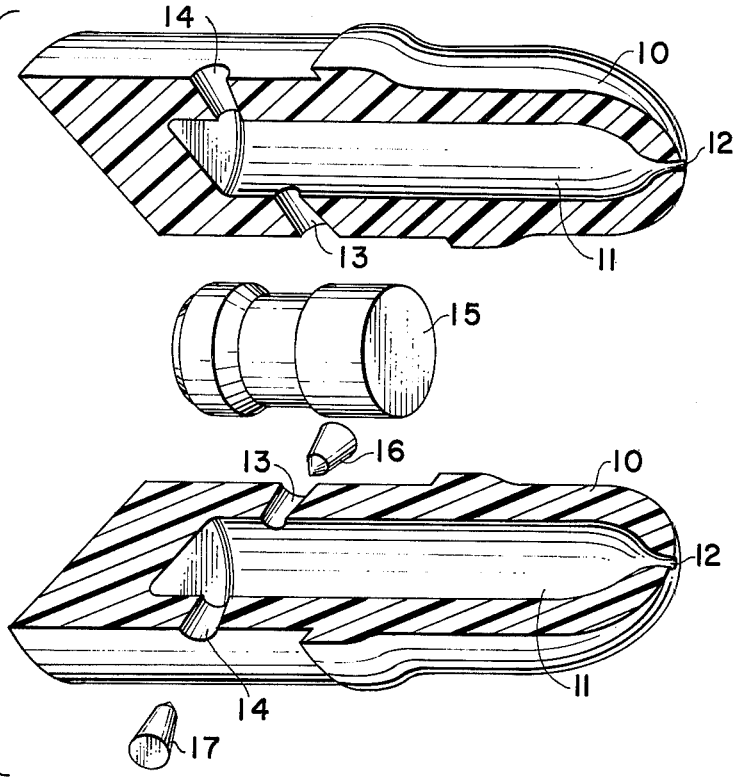
FIG. 2 is a cross-sectional perspective of both halves of the projectile body, with perspective views of the piston, retainer plugs, and retainer plug holes (sectioned).

FIG. 2 is a perspective view of both halves of such a projectile, longitudinally sectioned and showing the piston 15 and piston retainer plugs 16 and 17 adjacent to their positions in the manner of an exploded drawing.

Figure 3:
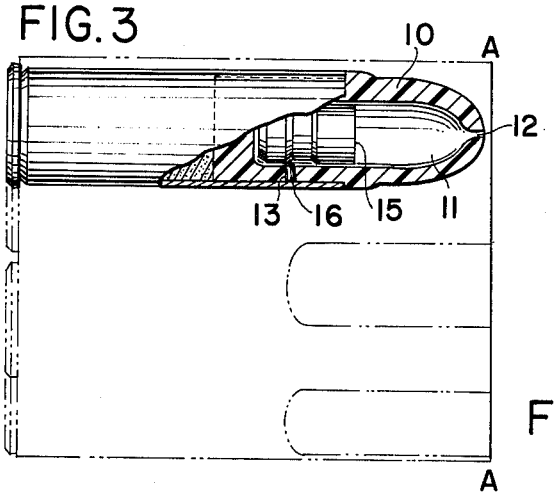
FIG. 3 is a partially cut-away plan view of the projectile seated in a suitable cartridge, in a revolver cylinder indicated by broken lines.

FIG. 3 is a plan view of this projectile seated in a suitable cartridge, with a section cut away. Line A represents the forward profile of the chamber of a revolver cylinder of corresponding caliber, denoting simply that the exemplary projectile is within the dimensions of a conventional bullet.

Figure 4:
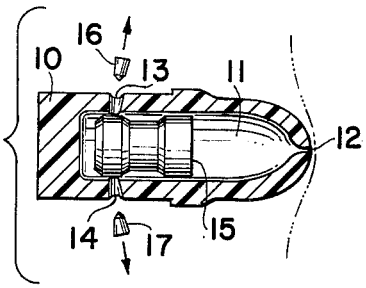
FIGS. 4 and 5 represent the projectile as it strikes in impinges intensely heated air upon the surface of its target, indicated by broken lines.

FIG. 4, a longitudinal cross-section, illustrates the expulsion of the piston retainer plugs 16 and 17 by the initial forward impulse of the piston 15, impelled by momentum upon impact with a target. As will be seen, the area of the piston base upon which the retainer plugs bear is beveled at a suitable angle to overcome their resistance to being unseated by the centrifugal force of projectile spin in flight, and/or by the piston's aforementioned tendency to creep forward during bullet flight.

In this embodiment, expulsion of the retainer plugs 16 and 17 admits air behind the piston through the retainer plug holes 13 and 14, so that there is no partial vacuum behind the piston to retard its forward travel.

Figure 5:
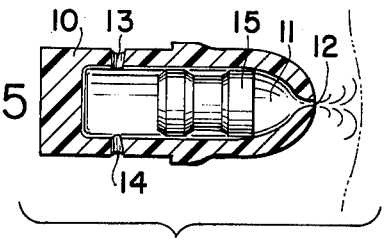

In FIG. 5, impact with the target has stopped the projectile body 10, while the piston 15 continues to be hurled forward by its momentum, transmitting its energy to the contained air which it compresses ahead of it. As this compression heats the contained air, the same momentum of piston 15 also expels the heated air and further heats it by friction with the pinhole aperture 12, through which it is expelled against the target.

It will be apparent that the embodiment illustrated is calculated to fulfill the above-stated objects of the invention, and it will be appreciated that the object invention is susceptible to modification, variation and change without departing from its scope as stated herein.

I claim:

1. A low-lethality projectile capable of incapacitating a living target notwithstanding the projectile's having a weight and mass light enough to make it unlikely to penetrate human or animal tissue sufficiently to cause a serious wound or a blunt trauma, and comprising means for generating intense heat in a suitable volume of air upon impact within a selected range upon an intended target.

2. The projectile of claim 1, wherein the means for generating heat in said volume of air comprises a chamber of suitable form within the projectile, and a piston slidable in said chamber, so as to compress said volume of air.

3. The projectile of claim 2, wherein the leading edge or portion toward the target of the projectile has a comparatively restricted or minute orifice communicating from said chamber to the atmosphere.

4. The projectile of claim 2, wherein the piston is by suitable means restrained from movement and retained in its rearmost position before and during firing and projectile flight.

5. The projectile of claim 4, wherein said restraining means is overcome by the impact of the projectile upon its target, allowing said piston to travel forward in relation to the projectile body.

6. The projectile of claim 5, wherein said restraining means comprises a plurality of retainer plugs bearing upon an annular beveled flange around the piston, so that the retainer plugs are unseated and expelled by the "set-forward" of projectile target impact.

7. The projectile of claim 2, wherein an appreciable part of the kinetic energy imparted to the projectile by being propelled from a firearm is converted by compression into heat, and transmitted by said volume of air as heat to the projectile's target.

8. The projectile of claim 7, wherein the projectile's light weight and mass render the projectile unlikely to inflict appreciable injury or damage beyond a comparatively short selected distance downrange.

9. The projectile of claim 2, wherein the projectile body's material, properties and dimensions are adaptable to its operation as a cartridge component in the actions of, and for firing by, various unmodified small-arms in general use.

* * * * *